United States Patent [19]

Stegmeier

[11] 4,299,513

[45] Nov. 10, 1981

[54] EDGE-SHAPING TOOL FOR FORMING SURFACE OF WET CONCRETE IN REGIONS ABUTTING A JOINT

[76] Inventor: William J. Stegmeier, 1073 Shary Cir., Concord, Calif. 94520

[21] Appl. No.: 92,982

[22] Filed: Nov. 9, 1979

[51] Int. Cl.[3] ..... E01C 19/22

[52] U.S. Cl. ..... 404/97; 15/105.5

[58] Field of Search ..... 404/97, 74, 96, 87, 404/89; 15/105.5, 235.8

[56] References Cited

U.S. PATENT DOCUMENTS

| | | | |
|---|---|---|---|
| 1,193,478 | 8/1916 | Downs | 15/105.5 |
| 1,273,060 | 7/1918 | Hoff | 404/97 |
| 1,585,571 | 5/1926 | Swanson | 404/97 |
| 1,899,183 | 2/1933 | Cruz | 404/97 |
| 3,758,909 | 9/1973 | Granger | 404/97 |
| 3,936,210 | 2/1976 | Oehlerking | 404/97 X |

*Primary Examiner*—Nile C. Byers, Jr.
*Attorney, Agent, or Firm*—C. Michael Zimmerman

[57] ABSTRACT

The tool consists of a pair of forming blades made of stainless steel held at a slight dihedral angle of 10°, with a gap between them wide enough to accommodate the surface of an expansion joint or drain. The blades are rigidly held by a cast aluminum bridge which arches over the gap. A pair of rubber wipers project slightly into the gap for clearing wet concrete from the surface of the expansion joint. The wipers are removably supported in aluminum wiper holders. Compressive spring force is generated by a steel rod extending between the blocks and through the arch of the bridge. Removal of a spacer on the steel rod permits sliding the wiper assembly aside sufficiently to release it from the tool to permit changing rubber wipers. A small amount of adjustment of the gap width to accommodate different width joints is permitted by means of movement of the blades in slotted openings in the bridge. Larger variations can be accommodated by substituting differently dimensioned blades.

23 Claims, 3 Drawing Figures

FIG. 2
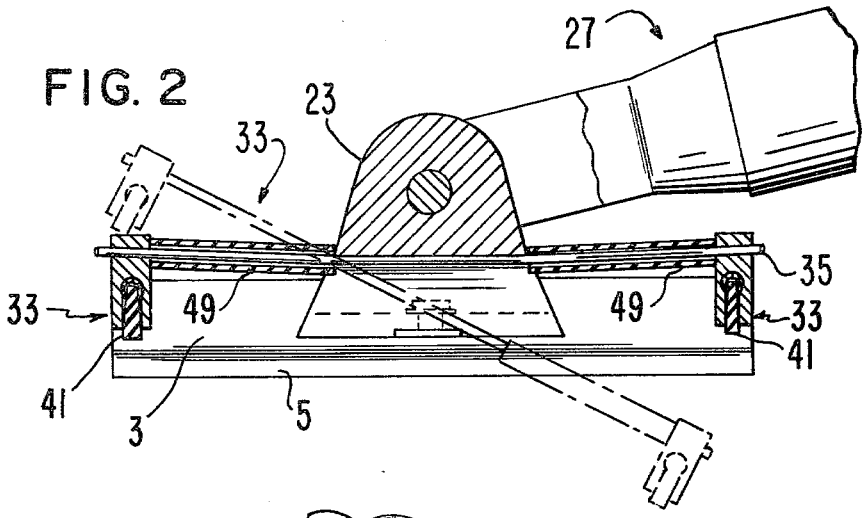
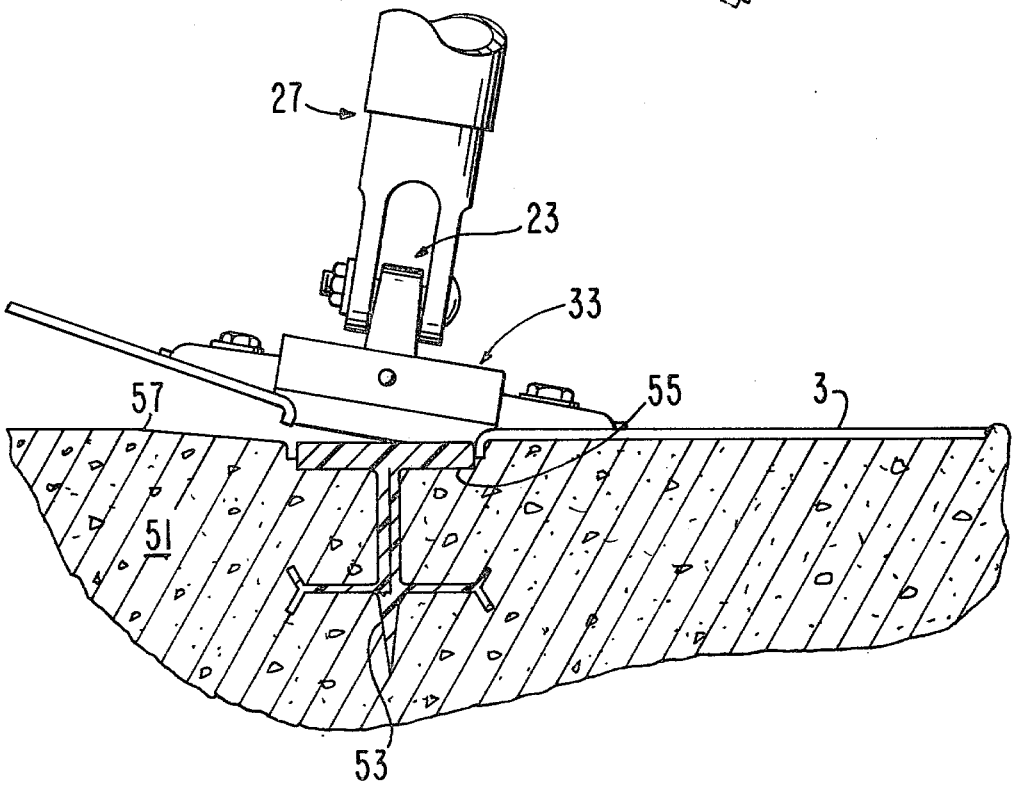
FIG. 3

EDGE-SHAPING TOOL FOR FORMING SURFACE OF WET CONCRETE IN REGIONS ABUTTING A JOINT

BACKGROUND OF THE INVENTION

Concrete, once considered a rather lowly material suitable mostly for fabricating building foundations, bridge abutments, and other starkly utilitarian structures has in this century come into widespread use as a prime architectural constituent used in all sorts of structures ranging from the utilitarian such as highway surfacing, structural beams and arches to partly or completely decorative uses in building interiors, sculpture, patios and plazas.

The widespread growth and acceptance of concrete in such a variety of forms and roles rests upon a growing body of concrete technology which has developed to cope with the diverse requirements made of concrete. A variety of composite structures in which the well-known ability of concrete to accept high compressive loading has been married to the high tensile strength of materials such as steel has permitted concrete to assume a larger role in the construction of arches, domes, trusses, and elevated beams.

At the same time, the aesthetic appeal of concrete structures has been significantly enhanced by advanced techniques of forming, shaping and molding together with widespread application of a variety of surface treatments involving color and texture designed to add versatility and a pleasing appearance to the other advantages of concrete.

In promoting the broader uses of concrete as an architectural material, the developers of concrete technology have had to consider both aesthetics and economics in their attempts to compete with other material technologies.

A prime example of these concerns occurs in the use of concrete to form large horizontal expanses such as plazas and decks or any other uses where an extensive layer of concrete is supported upon an underlying ground surface or subsoil. Such large expanses are subjected to a variety of potentially destructive agents both during their pouring or laying as well as afterwards. As is well known, the curing of concrete involves a considerable evolution of both water and heat. The resulting mechanical stresses can be accommodated without fracture in relatively small expanses of concrete, but they pose serious hazards as the area becomes larger. Even after the curing of the concrete it is subjected to the stresses resulting from earthquakes and other geologic phenomena, such as shifting subterranean strata caused by variations in water table level or subsoil shrinkage caused by declining moisture content in years of drought, shock waves caused by the nearby movement of heavy vehicles, and probably other sources.

As a result, it has always been essential to provide at regular intervals through such expanses of concrete, a series of "expansion joints" at which the inevitable shrinkage and slight shifting of the concrete could be accommodated. Such expansion joints may extend completely through the concrete layer or, more commonly, only from the surface to a depth partway therethrough. In the latter case, the concrete layer, being thinner in the region of the expansion joint will crack at this point rather than randomly over the surface. Since the expansion joint usually includes means to maintain a water seal to prevent subsoil erosion despite the crack in the concrete beneath it, and since the expansion joint also hides the crack from sight, such joints provide a worthwhile means of accommodating the inevitable.

In earlier times, expansion joints were often made of organic materials such as asphalted felt or wood. However, with the passage of time, such materials naturally degrade due to the action of water, sunlight, and oxygen. As a result they become unsightly and unsound, and require too-frequent replacement. Moreover, they do not adequately seal the joint against seepage of water into the underlying soil where erosion can further damage the concrete layer.

Consequently, a new type of expansion joint has come into being, utilizing relatively stable and inert plastic materials which are cheaper, more durable, and ultimately more beautiful than the old materials. The plastic materials resist the action of the elements better than the former wood or felt joints, can be easily fabricated in complex shapes, are available in a variety of colors and finishes, and have been designed to provide a much more satisfactory seal against water seepage into the underlying earth once the concrete has fractured at the site of the expansion joint. A particular type of such expansion joint is thoroughly detailed and covered in my U.S. Pat. No. 3,871,787 issued Mar. 18, 1975 and entitled "Joint Structure for Concrete Materials and the Like".

Similar molded plastic structures may also incorporate a plurality of apertures on the top surface thereof leading to a central hollow chamber which then serves as a drain while continuing to function as an expansion joint. Structures of this general type are exemplified by U.S. Pat. No. 3,465,654 issued Sept. 9, 1969 and entitled "Drain Device".

If devices of the above types are to become fully accepted and their full economic and aesthetic advantages realized, it is necessary to simplify as much as possible their laying and interfacing with the adjacent and abutting concrete areas. The finished interface between these materials and the adjacent concrete must insofar as possible retain the smooth, aesthetically pleasing appearance and be reproducible with a minimum of skill and effort without resorting to complex procedures.

The joint structure detailed in my earlier U.S. Pat. No. 3,871,787 referred to above is placed in the concrete after the latter has been poured and spread, but before it has cured. Thereafter, the concrete is tamped, surfaced with a "bull float", and then troweled and grooved. Following these operations, it is necessary to "edge" the concrete where it abuts the expansion joint. The device of the present application is a tool designed to facilitate and improve the result of this edging operation.

Such tools have existed in the prior art, consisting basicly of one or a pair of blades secured to a frame, the blade or blades being shaped so as to form the surface of the concrete to any desired shape in the area where it abuts an expansion joint or any other septum in the surface of the concrete layer. However, such tools have in the past been less than ideal in their conception and have suffered from a number of design faults which rendered their use somewhat awkward and difficult.

In particular, in view of the wide variety of expansion joints, drains and other septa coming into use in concrete work provision needs to be made for adjustability and adaptability in the edging tool. Since the widths of the various joints may vary according to the design and intended usage, it is desirable that the edging tool provide for adjustment or adaptation to accommodate different widths of the septum or joint. Moreover, it is desirable that the shape produced at the edge of the abutting concrete layer be variable to accommodate different needs.

As noted above, the septum or joint is placed in the concrete while the latter is uncured and still wet, and a number of operations are performed prior to the edging operation adjacent the joint. As a result, the top of the joint is usually covered with a layer of concrete which must be swept away as a part of the edging operation.

Prior art edging tools have used resilient rubber wiping blades to achieve this purpose. However, the method of securing these blades in position and removing them from the tool when they need replacement or to permit edging without the wiping blades (for example as a finishing step) has been difficult.

In particular, the rubber wipers in the prior art have typically been held by various fixed clamps often involving set screws or similar means for securing the rubber wipers. Consequently, proper adjustment of the position of the wipers has been difficult to achieve, and removal and replacement of the wipers an unnecessarily tedious operation.

SUMMARY OF THE INVENTION

The principal object of the present invention is to provide an edging tool for shaping and smoothing the uncured surface of a concrete or other cure-hardening medium in the regions thereof abutting and adjacent a septum in the surface of the medium.

A second object of the present invention is to provide such a tool having a pair of forming members or blades providing forming surfaces which are spaced apart to provide a gap between them the width of the septum.

A third object of the present invention is to provide such a tool in which the width of the gap between the blades is adjustable to accommodate a variety of widths of septa.

A fourth object of the present invention is to provide such a tool in which resilient wiping means are provided within the gap, releasably held therewithin under a spring compressive force.

A fifth object of the present invention is to provide such a tool in which the forming members are securely but removably held in the correct orientation.

A sixth object of the present invention is to provide a tool in which the resilient wiping means includes wiper blocks which are securely but removably and replaceably held within wiper block holders, and in which the wiper block holders are securely fastened at the end of a spring beam, which beam is bent to apply the spring compressive force on the wiping means.

The above objects and others are achieved according to the present invention by a tool in which a pair of forming blades are rigidly fastened together by means of a bridge member which supports the blades in alignment but spaced apart to define a gap between them of a width to accommodate the top surface of a septum or expansion joint. The bridge member includes an arch portion which extends over the gap and above the blades. A spring-biased resilient wiper assembly consists of a pair of rubber wipers, each removably held in a rigid wiper holder, the holders being joined together by a single spring beam which bends as it passes through the arch of the bridge member, generating the spring compressive force on the rubber wipers. A pair of spacers in the form of sleeves on the spring beam maintains the spring-biased resilient wiper assembly in accurate fore-and-aft alignment on the tool. Either spacer is quickly removable to permit the sliding of the spring-biased assembly in a direction longitudinally along the gap until one of the rubber wiper blocks is disengaged from the blades. The entire spring-biased assembly can then be quickly removed for replacement of the rubber wipers. The blades are held to the bridge member by a tongue-and-groove type of joint which is held together by a screw passing through a slot in the bridge member. Since the tongue-in-groove joint is oriented to permit sideways movement of the blade with respect to the bridge member, the use of a slot permits tightening of the screw in any of a variety of lateral positions to permit adjustment of the width of the gap.

The above and other features, objects, and advantages of the present invention, together with the best mode contemplated by the inventor thereof for carrying out his invention will become more apparent from reading the following detailed description of a preferred embodiment and perusing the drawings in which:

BRIEF DESCRIPTION OF THE DRAWINGS

FIG. 2 is a side view of the tool of FIG. 1, partially in elevation and partially in section along line 2—2 in FIG. 1;

FIG. 3 is a longitudinal view partially in elevation and partially in section, showing the edge-shaping tool in use.

DETAILED DESCRIPTION OF A PREFERRED EMBODIMENT

Figure 1:
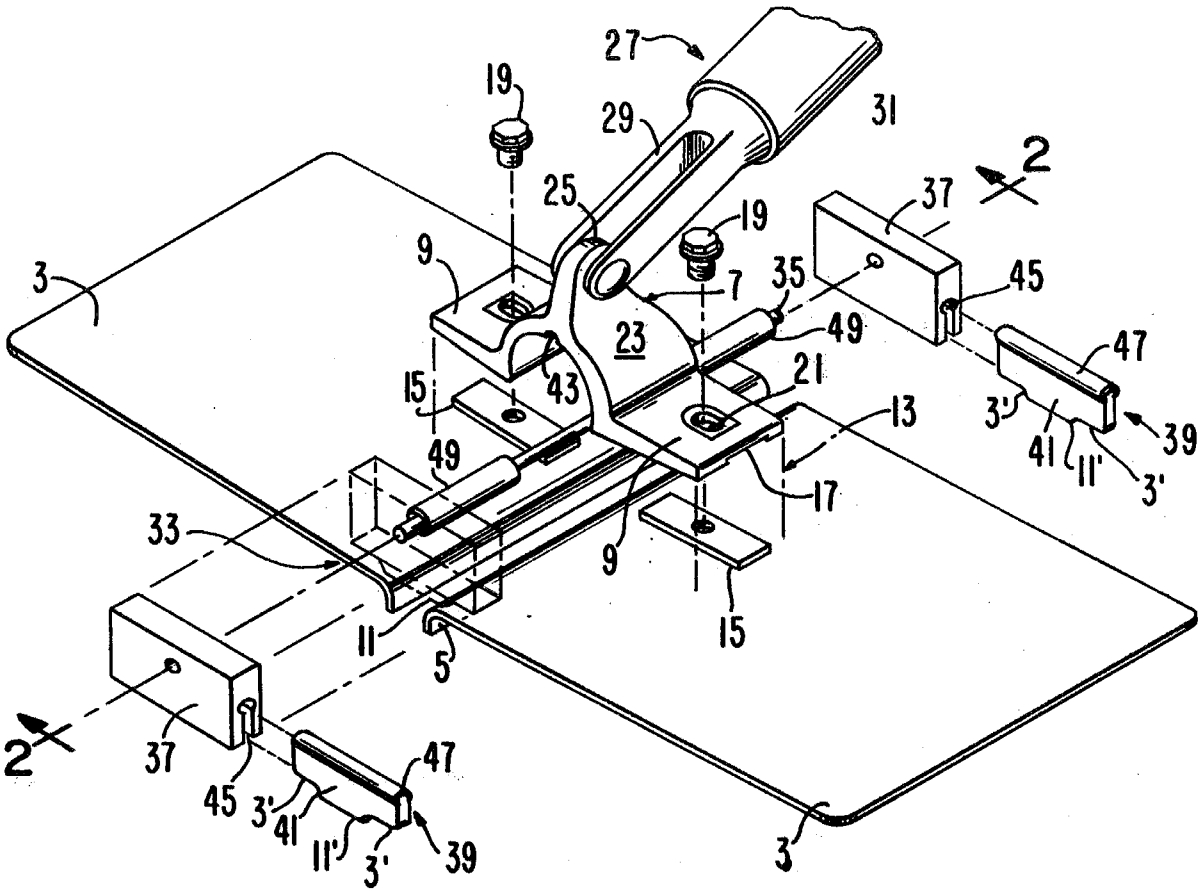
FIG. 1 is an exploded isometric view of the edge-shaping tool of the present invention.

In FIG. 1, an edge-shaping tool 1 according to the present invention is illustrated in an exploded perspective view which clearly delineates the structural interrelationship of the parts. For smoothing and shaping the surface of a cure-hardening medium such as concrete in the regions immediately adjacent and abutting a septum in the surface of the medium, such as an expansion joint or drain, a pair of forming members which, in FIG. 1, comprise blades 3 may be used. Blades 3, which may be formed from stainless or carbon steel sheet stock of, for example, 1.25 mm thickness may be approximately 15×15 cm in dimension. When made of such relatively light sheet stock, blade 3 may be produced by sheering and bending operations. In the event that a high carbon spring steel stock is used, the surfaces of blades 3 are desirably plated, blued, or otherwise treated to inhibit rusting and corrosion.

As shown in both FIGS. 1 and 3, blades 3 may desirably be provided with a rolled-over edge 5 which may be formed by bending the edge of each blade 3 through approximately 90° on a radius of approximately 5 mm.

A bridge member 7 serves to rigidly interconnect blades 3 while preserving a selected spacing between rolled-over edges 5 adequate to accommodate the width of a surface septum between edges 5. Bridge member 7 which may be formed of aluminum by casting or forging provides at its outer ends a pair of blade mounting portions 9 which are formed with flat mounting surfaces on their undersides where they abut blades 3. Blade mounting portions 9 may be made coplanar, but are desirably provided with a slight angular offset such that they hold blades 3 at a slight dihedral angle as of 10°, as can be noted, for example, in FIG. 3.

Blades 3 are mounted on blade mounting portions 9 with rolled-over edges 5 parallel to and facing one another across a gap 11 of a width accurately dimensioned to be the same as the top surface width of a surface septum with which tool 1 will be used. To this end, blade mounting portions 9 and blades 3 are provided with releasable attachment means 13 which provide for secure mounting of the blades in the proper alignment and with the proper width of gap 11. When blades 3 are so mounted, their lower surfaces become concrete forming surfaces whose shape and relative orientation conform generally to the desired surface shape of the concrete in the regions adjacent a septum in the surface of a concrete layer.

Attachment means 13 as shown in FIG. 1 comprise a generally tongue-and-groove joint in which an alignment lug 15 on each of blades 3 is received within a correspondingly shaped and dimensioned recess 17 on each of blade mounting portions 9. A mounting screw 19 passes through each blade mounting portion 9 and threads into alignment lug 15 and blade 3, thus completing releasable attachment means 13. Screws 19 may be provided with lock washers to prevent accidental loosening, or they may be of the captive lock washer or "sems" type.

Alignment lugs 15 may be of 3.75 mm thick sheet stock of the same material used for blades 3 and may be fastened to blades 3 by spot welding, for example. The undersurfaces of blade mounting portions 9 including recesses 17 may desirably by formed by milling such that a precision fit with the corresponding surfaces of lugs 15 and blades 3 is provided. As shown, blade mounting portions 9 are spot-faced where screws 19 pass through them in order to provide a flat surface, parallel to the plane of blade 3, for abutment with the head of screws 19 so as to prevent distortion of screws 19, lugs 15, or blades 3 upon tightening.

Since the width of gap 11 must be variable in order to accommodate a variety of different types of expansion joints or other surface septa in the surface of concrete, blade mounting portions 9 are provided with slots 21 to permit blades 3 to move slightly from side to side for adjustment of the width of gap 11. For the same reason, alignment lugs 15 and recesses 17 are oriented so as to permit lateral movement of blades 3. Furthermore, tool 1 may be provided with sets of interchangeable blades having different standard widths of gap 11 in order to further extend the range or versatility of the tool.

Blade mounting portions 9 are connected together by an arch portion 23 of bridge member 7, extending over and above gap 11. By means of a mounting ear 25, a handle 27 is joined to bridge member 7. Handle 27 consists of a mounting fork 29 and an extension tube 31 which may be made any convenient length and also may be made in sections. Mounting fork 29 may be made as a forging, casting, or weldment. In the event that weldment is chosen as a means of fabricating fork 29, mild steel makes an excellent choice of material which does not require inert gas techniques to achieve a satisfactory weld. The plates of fork 29 may be formed simply by bending a U-shaped piece out of 4.5 mm×25 mm mild steel stock. The resulting "U" can then be welded or brazed into the open end of a piece of thick-walled mild steel tubing, the open end of which can be flattened slightly to provide a good fit with the joining piece of steel strap. Similarly, extension tube 31 may be joined to mounting fork 29 by welding or brazing in the event that an easily weldable material such as mild steel is used for tube 31. However, in the interests of handling ease and appearance I have found that aluminum tubing as of 35 mm o.d. and 1.25 mm wall thickness makes an excellent handle. Such aluminum tubing is available with multicolored anodized finishes which are attractive and resist abrasion well. In the event that aluminum tubing is chosen, I have found that a satisfactory joint between extension tube 31 and mounting fork 29 can be produced by staking or crimping the two together.

In accordance with the present invention, tool 1 includes a resilient wiping means 33 which is positioned generally over and within gap 11 and is releasably held therewithin under spring compresive force as will become apparent from what follows. Resilient wiping means 33 comprises a spring beam 35 which may be made of 3.5 mm oil-tempered, high-carbon steel rod extending between a pair of wiper block holders 37 which may be made of 6061-T6 forged aluminum bar stock, for example, or from any other durable, rigid, easily machinable material. Spring beam 35 extends through wiper block holders 37 and may be flattened or peened on its ends or otherwise upset to prevent accidental disassembly of these parts.

Within each wiper holder 37 is disposed a rubber wiper 39 including a wiper block 41 which may be cut from 6.35 mm pure natural rubber sheet stock, for example. A projecting portion 11′ of wiper block 41 extends into gap 11 when resilient wiping means 33 is in position on tool 1 and is so shaped as to extend approximately to the level of the lower surfaces of blades 3. Projecting portion 11′ is actually formed in practice by cutting recessed surface portions 3′ on the lower surface of block 41. Recessed surface portions 3′ are desirably shaped to match the shape of the corresponding edge regions of blades 3, which they will abut in practice.

As can be seen in FIG. 1, arch portion 23 is provided with a longitudinally extending recess 43 which is dimensioned to receive and accurately align spring beam 35 over gap 11. Wiper block holders 37 are provided with laterally extending recesses 45 within which rubber wipers 39 are received. Each rubber wiper 39 is provided with a metal shoe 47 which may be made of mild steel tubing cut in sections the length of rubber wiper 39, slit and clamped closed over rubber wiper 39. Metal shoe 47 serves to stiffen wiper block 41 and to provide for secure mounting thereof. Laterally extending recesses 45 are provided in wiper block holders 37 and are shaped such that once rubber wiper 39 has been slid into wiper block holder 37, laterally extending recesses 45 securely enclose rubber wiper 39 preventing it from dropping out and providing a considerable further stiffening effect against flexure in use.

As can be seen in both FIGS. 1 and 2, a pair of tubular spacers 49 which may be simply sections cut from high pressure air hose, extend between wiper holders 37 along spring beam 35, abutting on arch portion 23. Tubular spacers 49 serve to maintain resilient wiping means 33 in proper position with rubber wipers 39 resting on the upper surfaces of blades 3 near the ends of gap 11. Tubular spacers 49 are desirably split along their lengths permitting their convenient removal in the event that it is necessary to remove resilient wiping means 33 from tool 1. As can be seen by the phantom showing of resilient wiping means 33 in FIG. 2, once one of spacers 49 has been removed, it is possible to slide the entire resilient wiping means 33 in a longitudinal direction (along gap 11) until one of rubber wipers 39 is clear of the upper surfaces of blades 3. At this point it is possible to swing the entire assembly of resilient wiping means 33 down and away from blades 3 such that it can easily be disengaged from the tool when necessary to replace rubber wipers 39 or when their action is not needed.

As can also be seen in FIG. 2, the assembly of resilient wiping means 33 is dimensioned with respect to height of arch portion 23 such that when resilient wiping means 33 is in place, spring beam 35 is deflected as it passes through arch portion 23 so as to generate spring compressive force on rubber wiper blocks 41, urging them toward gap 11 and maintaining portion 11' within gap 11 (FIG. 1), while all other surface portions of wiper block 41 are firmly compressed against the abutting surfaces of metal shoe 47, laterally extending recesses 45 and the upper surfaces of blades 3 (FIG. 1).

Since wiper block 41 is nearly fully confined by surrounding, unyielding metallic surfaces against which it is pressed under the influence of the spring compressive force generated by deflection of spring beam 35, the rubber material of rubber block 41 is quite fully supported and firmly held in position to a degree adequate to resist any tendency of the forces generated by the wiping action occuring at portion 11' from dislodging or misaligning wiper block 41. In short, unlike the prior art constructions in which the rubber wiper blocks 41 were merely clamped by set screws, the construction of the present invention ensures that these blocks are firmly held in place but are quickly replaceable when desired.

In FIG. 3, the tool 1 of the present invention is shown in use smoothing and shaping the surface of a concrete layer 51 into which an expansion joint 53 according to my aforementioned U.S. Pat. No. 3,871,787 has been inserted. Expansion joint 53 includes a top flange 55 which, when the joint is properly inserted will rest slightly below the remainder of concrete layer 51. Consequently, as already noted in this application, the upper surface of top flange 55 becomes covered with a thin layer of concrete during the surfacing operations following insertion of expansion joint 53.

Consequently, in use a first pass is made with tool 1 in which handle 27 is held upright, i.e. approximately perpendicular to the surface of concrete layer 51. Tool 1 is then struck through the surface of the concrete layer 51 such that blades 3 abut the sides of top flange 55. Because of the slight dihedral angle as of 10° between blades 3, the first pass over and along expansion joint 53 removes some concrete on either side of joint 53 to form tapered sides 57, one of which is shown in FIG. 3. At the same time during this first pass, very nearly all of the concrete covering top flange 55 is removed by wiper blocks 41. During this first pass the top surface of top flange 55 would ordinarily be covered by a layer of removable tape which has been applied to flange 55 during manufacture to protect the finish of this surface from the abrasive action of the concrete aggregate during the finishing operation.

With the surface of top flange 55 clean, and slight tapers 57 formed on the abutting portions of the concrete layer 51, the second pass is initiated. Prior to the second pass, resilient wiping means 33 may be removed entirely from the tool 1 since its function of cleaning top flange 55 of concrete has already been accomplished. Alternatively, it may be left in place since it generally will not interfere with the following passes of tool 1.

During the second pass, tool 1 is held with the handle 27 tilted slightly to one side or the other such that one of blades 3 (the right one in FIG. 3) is very nearly parallel to the surface of concrete layer 51. Consequently, the other blade 3, because of the dihedral angle between the blades, will be lifted away from the surface of concrete layer 51. During this second pass, then, the short tapered edge 57 on one side of expansion joint 53 is reshaped into a short section of concrete surface which lies parallel to but slightly depressed from the main surface of concrete layer 51. At the same time, the abutting edge of concrete layer 51 is given a radius of the proper orientation by rolled-over edge 5 such that one side of the concrete layer 51 (right side in FIG. 3) is now in virtually finished form.

The final, third pass is similar to the second pass except that the tool is tilted slightly to the other side of the expansion joint 53 and that side is finished as described above. The small amounts of concrete removed during these edging operations are carefully cleaned away and the edging operation is complete.

Although the invention has been described with some particularity in reference to a preferred embodiment which comprises the best mode contemplated by the inventor for carrying out his invention, it will be obvious to those skilled in the art that many modifications could be made and many apparently different embodiments of the invention thus derived without exceeding the scope of the invention. Consequently, it is intended that the scope of the invention be interpreted only from the following claims.

I claim:

1. A tool for shaping and smoothing the uncured surface of a cure-hardening medium in the regions thereof abutting and adjacent a septum in the surface of said medium, comprising: a pair of forming members, each forming member providing a forming surface of a shape and relative orientation selected to generally conform to the desired surface shape of said medium in said regions, each of said forming members having an edge which is spaced from and faces a corresponding edge on the other of said forming members, said edges defining a gap therebetween of a width sufficient to receive a surface portion of said septum and a resilient wiping means including a wiper block extending into and generally in a direction transverse to said gap and having a length, in said direction transverse to said gap, which is greater than the width of said gap, said wiper block being maintained in compressive abuttment with the adjacent portion of said forming members on each side of said gap.

2. The tool of claim 1 wherein each of said forming members provides a second surface adjacent said gap and on the side of the forming member facing away from said forming surface for supporting the wiper block, and further including a spring urging said resilient wiping means toward said second surfaces and said gap, whereby said spring together with said second surfaces cooperate to generate a holding compressive force.

3. The tool of claim 1 wherein said wiper block is provided with recessed surface portions where it abuts said adjacent portions of said forming members and a central projecting surface portion extending into said gap.

4. The tool of claim 1 wherein said wiper block comprises a resilient and compressible material.

5. The tool of claim 4 wherein said material comprises a block of natural rubber.

6. The tool of claim 4 wherein said wiper block further comprises a means to stiffen said resilient compressible material.

7. The tool of claim 6 wherein said means to stiffen comprises a metal shoe attached to said resilient and compressible material along one edge thereof.

8. The tool of claim 1 further including a wiper block holder having a recess therewithin receiving and holding said wiper block.

9. The tool of claim 8 wherein said wiper block comprises a block of resilient and compressible material having fastened along one edge thereof a shoe, said shoe being made of a generally rigid material, and being shaped and dimensioned, and said recess of said wiper block holder being shaped and dimensioned so that said shoe is captured in said recess when said wiper block is inserted in said holder.

10. The tool of claim 1 further comprising a bridge member mechanically interconnecting said forming members and extending across said gap, and a spring beam extending between said bridge member and said wiper block to urge said wiper block toward said gap.

11. The tool of claim 10 wherein the resilient wiping means includes a pair of wiper blocks secured to the spring beam spaced apart from each other.

12. A tool for shaping and smoothing the uncured surface of a cure-hardening medium in the regions thereof abutting and adjacent a septum in the surface of said medium, comprising: a pair of forming members, each forming member providing a forming surface of a shape and relative orientation selected to generally conform to the desired surface shape of said medium in said regions, each of said forming members having an edge which is spaced from and faces a corresponding edge on the other of said forming members, said edges defining a gap therebetween of a width sufficient to receive a surface portion of said septum, a bridge member mechanically interconnecting said forming members and extending across said gap, first and second resilient wiper blocks positioned generally across and extending within said gap, and a spring beam extending between said bridge member and said first and second wiper blocks, said bridge member including an arch portion extending over said gap and being spaced away from the adjacent surfaces of said forming members, said spring beam, wiper blocks and arch portion being so dimensioned as to: permit said blocks to be positioned with one block on each side of said arch portion with said spring beam extending through said arch portion; cause said spring beam to be deflected by said arch portion to generate a spring compressive force for all maintaining said blocks in position.

13. The tool of claim 12 wherein said arch portion is provided with a recess for engaging said spring beam in an orientation aligned with the axis of said gap.

14. The tool of claim 12 further comprising spacers removably received on said spring beam between each of said wiper blocks and said arch portion to substantially prevent movement of said wiper blocks in a direction along the axis of said gap.

15. A tool for shaping and smoothing the uncured surface of a cure-hardening medium in the regions thereof abutting and adjacent a septum in the surface of said medium while supporting a pair of resilient wiper blocks for engaging the surface of said septum comprising: a pair of forming members, each forming member providing a forming surface of a shape selected to generally conform to the desired surface shape of said medium in said regions, each forming member having a projecting lip along an edge thereof extending in the facing direction of the forming surface; a bridge member secured to said pair of forming members to hold them in relation to each other in a desired orientation with the projecting lips of the forming members in spaced juxtaposition, said spaced projecting lips defining a gap therebetween of a width sufficient to receive a surface portion of said septum; and a spring beam engaging the bridge member at a location along said beam between its opposite ends, each end of the spring beam having means for securing said spring beam to one of the pair of resilient wiper blocks, the bridge member and spring beam are dimensioned relative to said wiper blocks so that said wiper blocks are urged against the forming members when secured to said spring beam engaging said bridge member.

16. The tool of claim 14 wherein the wiper blocks have attaching means that connect to the spring beam, said attaching means located above the forming members a first distance, and the beam engaging said attaching means and extending from said bridge member at a location above the the forming members a second distance less than said first distance whereby said spring beam is stressed to urge and secure said wiper blocks in position against said forming members.

17. A wiping means for use in a tool for shaping and smoothing the uncured surface of a cure-hardening medium in the regions thereof abutting and adjacent a septum in the surface of said medium, said tool including a pair of forming members and a means for mounting said forming members in spaced juxtaposition to define a gap therebetween of a width corresponding to the width of the septum, each forming member providing a forming surface on a first side thereof and a second surface adjacent said gap on a second side opposite said first side for supporting said wiping means, said wiping means comprising: a block of wiping material having a length dimension substantially greater than the width of the gap defined between the forming members, said block of wiping material having a projecting segment along an edge of an intermediate interval of its length dimension corresponding to the width of said gap; means holding said block of wiping material; and attaching means connected to said holding means for securing said wiping means to said tool.

18. The wiping means of claim 17 wherein the block of wiping material is comprised of two generally rectangular portions of different length dimensions, the generally rectangular portion of smaller length dimension extending from the portion of greater length dimension along the intermediate interval of said block of wiping material to define the projecting segment of said block.

19. The wiping means of claim 17 wherein the means holding the block of wiping material includes a shoe member receiving and holding said block of wiping material along an edge of said block opposite the edge having the projecting segment, said shoe member connected to the attaching means.

20. The wiping means of claim 17 wherein the means holding the block of wiping material further includes a block member defining a recess along an edge thereof receiving and supporting the shoe member and the block of wiping material with the projecting segment of the block of wiping material extending outside of said recess, said block member connected to the attaching means.

21. The wiping means of claim 20 wherein the attaching means is an aperture defined by a wall of the block member that receives a mating member for securing said wiping means to said tool.

22. The wiping means of claim 20 wherein the attaching means is connected to the block member proximate a side thereof opposite the opening of the recess.

23. The wiping means of claim 17 wherein the wiping material is of natural rubber, and the means holding the block of wiping material is a structure of rigid material.

* * * * *